United States Patent [19]

Liedke

[11] 4,102,242

[45] Jul. 25, 1978

[54] AUTOLOADING GAS-OPERATED FIREARM

[75] Inventor: Carl F. Liedke, North Haven, Conn.

[73] Assignee: O. F. Mossberg & Sons, Inc., North Haven, Conn.

[21] Appl. No.: 768,041

[22] Filed: Feb. 14, 1977

Related U.S. Application Data

[63] Continuation-in-part of Ser. No. 601,627, Aug. 4, 1975, abandoned.

[51] Int. Cl.[2] ..... F41D 5/04

[52] U.S. Cl. ..... 89/191 R

[58] Field of Search ..... 89/191–193

[56] References Cited

U.S. PATENT DOCUMENTS

| | | | |
|---|---|---|---|
| 2,365,142 | 12/1944 | Turner | 89/193 |
| 2,409,225 | 10/1946 | Schaich | 89/193 |
| 2,487,198 | 11/1949 | Swebilius | 89/191 |
| 2,494,889 | 1/1950 | Maillard | 89/191 |
| 2,554,618 | 5/1951 | Dixon | 89/193 |
| 2,818,785 | 1/1958 | Maillard | 89/193 |
| 2,909,101 | 10/1959 | Hillberg | 89/191 A |
| 3,174,401 | 3/1965 | Beretta | 89/192 |
| 3,200,710 | 8/1965 | Kelly et al. | 89/191 A |
| 3,680,433 | 8/1972 | Tollinger | 89/191 X |
| 3,848,511 | 11/1974 | Zanoni | 89/191 A |

FOREIGN PATENT DOCUMENTS

| | | | |
|---|---|---|---|
| 1,313,010 | 11/1962 | France | 89/191 |

*Primary Examiner*—David H. Brown

*Attorney, Agent, or Firm*—St. Onge, Mayers, Steward & Reens

[57] ABSTRACT

A gas-power system for an autoloading shotgun in which a pair of gas cylinders are mounted on opposite sides of and between the barrel and the magazine tube. An inertial weight is slidably mounted on the magazine for engagement by the pistons, which are positively retained within their cylinders for limited movement when a shell is discharged. The inertial weight is connected to the bolt-mechanism by a pair of action bars.

9 Claims, 9 Drawing Figures

AUTOLOADING GAS-OPERATED FIREARM

This application is a continuation-in-part of co-pending application Ser. No. 601,627 filed Aug. 4, 1975 now abandoned.

BACKGROUND OF THE INVENTION

The present invention relates to gas-operated, autoloading shotguns, and it relates more particularly to an improved autoloading gas-power system therefor.

Gas-operated firearms usually include a receiver and a breech-bolt mechanism mounted for reciprocal movement to and from battery position in the receiver. The bolt mechanism is mechanically linked to a piston and cylinder assembly which is automatically operated by a portion of the pressurized gas developed on discharge of a round and bled from the gun barrel to the cylinder. Energy of the pressurized gas is converted into mechanical energy through movement of the piston that is utilized to mechanically unlock the bolt mechanism after firing, withdraw the bolt mechanism from battery position, eject the spent shell, and advance a fresh shell into position for loading into a breech chamber. Simultaneously, an action spring coupled to the bolt mechanism is compressed. Subsequently, the action spring returns the bolt mechanism to the battery position, loading the fresh shell into the breech chamber.

The basic design and principles of operation of autoloading, gas-operated firearms are well known. However, certain difficulties have been encountered in prior gas-operated shotguns, one of which has been in providing a gas-system which is efficient and reliable, while at the same time permits the firearm to be acceptable in appearance, have good balance, and proper "feel" when handled by the shooter. It is also generally recognized that in order to obtain the desired magazine capacity, reliable feeding of the cartridge from the magazine to the cartridge chamber and proper balance of the firearm, it is essential to use a tubular magazine mounted below a parallel to the barrel within the so-called forend of the gun.

The location of the magazine as well as the arrangement and location of the piston-cylinder assembly all play an important role in determining the balance, sighting, and "feel" characteristics of the gun. Another basic problem encountered in the design of a suitable gas-operated shotgun with a tubular magazine is that, in order to fire both low and high power ammunition, the gas cylinder must be mounted where the magazine tube is located and the piston must have sufficient cross-sectional area to provide the power needed to compress the action-return spring, as well as to overcome the friction and other resistance to movement of the bolt when low-power cartridges are fired.

The U.S. Pat. to Hillberg No. 2,909,101 discloses one way of overcoming this problem by placing an annular piston around the outside of the magazine with an annular cylinder similarly mounted so that the gas take-off can be located at the required distance from the cartridge chamber without shortening the magazine. In this arrangement the annular piston surrounding the magazine tube provides the needed piston area without having to increase the size of the forend so much that the gun is undesirably bulky in the forend and awkward to handle. One of the difficulties with the Hillberg design is that the annular piston must have a gas-tight fit with the magazine tube on which it slides. This requires close manufacturing tolerances in order to maintain concentricity and alignment between the piston and the magazine tube over the full distance the piston travels with the action of the gun. Any out-of-roundness of the magazine or other deformation results in binding of the annular piston. But even when alignment is good and tolerances are met, an undesirable amount of wear occurs between the piston and the magazine tube due to the tight fit which the piston must have with the outer surface of the tube. Furthermore, in annular-piston gas systems, such as that of Hillberg as well as that of the short-stroke annular-piston designs of Kelly et al U.S. Pat. No. 3,200,710 and Zanoni 3,848,511, there is inherently a substantial loss of power due to leakage of gas between the magazine tube and the piston and between the piston and the outer walls of the cylinder.

Alternative arrangements have been to mount the gas piston and cylinder within the magazine tube, as disclosed in the U.S. Pat. to Sefried No. 2,482,880, or to mount them in front of the magazine as disclosed in U.S. Pat. No. 3,680,433 to Tollinger. However, these designs reduce the capacity of the magazine due to the fact that the gas take-off port must be located relatively near the shell chamber in order to operate satifactorily with low-power ammunition. Another alternative is to mount the gas piston and cylinder around the barrel as shown in U.S. Pat. to J. E. Browning No. 2,252,754. This arrangement, however, is not satisfactory for a sporting arm because of the bulkiness of the piston and cylinder on the barrel, which not only is unpleasant in appearance, but also prevents proper sighting of the gun.

It is an object of the present invention to provide a gas-operated autoloading shotgun equipped with a compact gas-power system having excellent feel and balance. It is also an object of the invention to provide an improved gas-power system that is reliable in operation and economical to manufacture and maintain.

SUMMARY OF THE INVENTION

Broadly the invention resides in providing a gas-operated autoloading shotgun with a pair of gas cylinders, symmetrically disposed in the opposing, outwardly opening V-shaped regions formed between the barrel and magazine, and having a pair of action-bars disposed intermediate the barrel and magazine such that each action-bar is substantially in line with one of the pistons for transmitting the force exerted by each piston in a straight line to the bolt or slide therefor, thereby reducing the resistance due to friction as much as possible. This in turn makes it possible to use power cylinders which are small enough to fit within the extremely limited space available, but which never-the-less are capable of furnishing the power needed to function the gun properly.

Another aspect of the invention resides in a self-contained gas-system for a gas-operated autoloading shotgun in which a pair of gas cylinders are detachably mounted on a bracket rigidly attached to the barrel, the bracket having a pair of open bores for removably receiving cylindrical extensions on each of the cylinders through which gas-ports or passages are provided for interconnecting the interior of the barrel with the interior of each of the cylinders. In this way the gas cylinders are readily removed for cleaning purposes.

Another feature of the invention resides in a unique piston-cylinder assemblage in which an elongate stud or abutment member bridges the space between the two cylinders by extending between the barrel and magazine and through the side walls of the cylinders so that the opposite ends of the stud project into slots in the sides of the pistons and provide stops for limiting the distance which the pistons can move within their respective cylinders.

DETAILED DESCRIPTION OF THE PREFERRED EMBODIMENT

Figure 1:
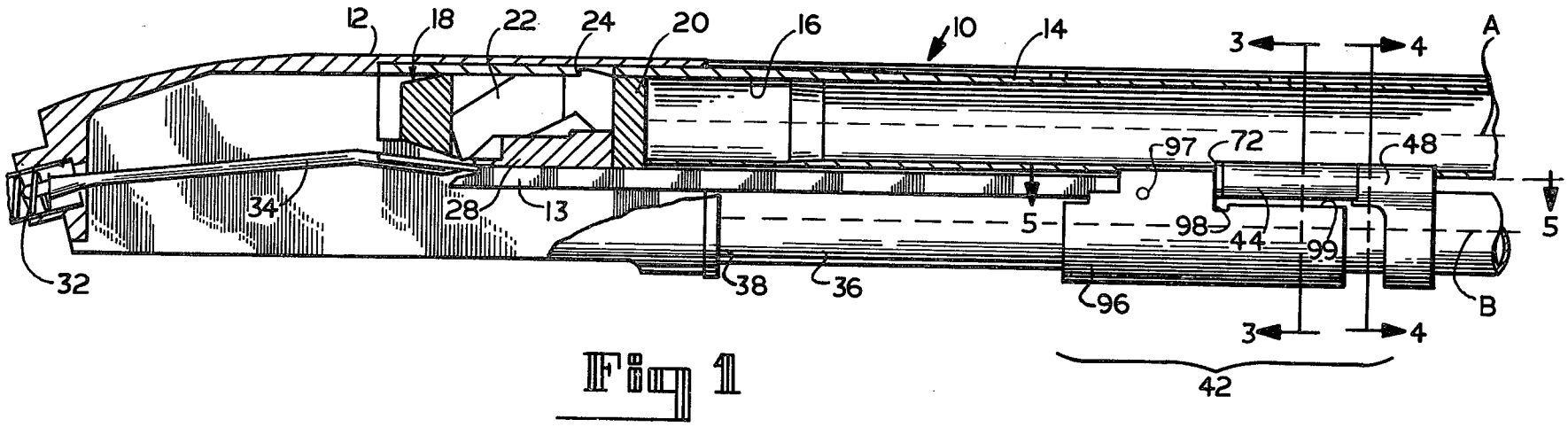
FIG. 1 is a fragmentary longitudinal view of a shotgun in which the improved autoloading gas system of the present invention is installed, the barrel and receiver being shown in section, and the bolt mechanism, which is schematically illustrated, being shown in battery position, the usual forend having been removed.

As shown in FIG. 1, a shotgun 10 includes a receiver 12 to which a barrel 14 is removably secured. A cartridge chamber 16, which receives a shell when the shotgun is loaded, is machined in the interior of barrel 14.

Figure 2:
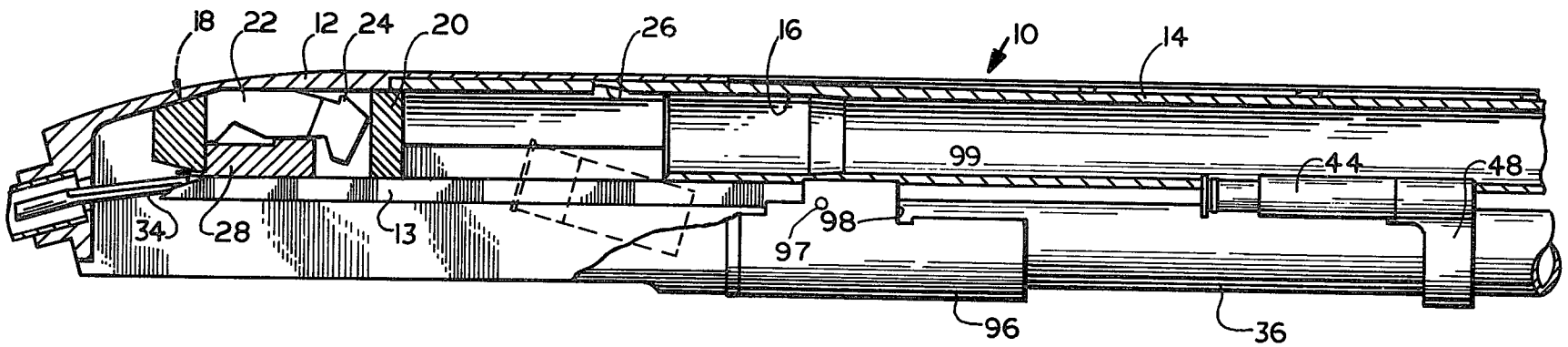
FIG. 2 is a view similar to FIG. 1 showing the bolt mechanism in its rearmost position.

A breech-bolt mechanism, generally indicated at 18, is reciprocally mounted in receiver 12 for actuation by a pair of action bars 13, 13 for movement to a battery postion (FIG. 1), and to a retracted position (FIG. 2). Both mechanism 18 includes a breech bolt 20 that houses a firing pin (not shown) to discharge a loaded shell. A tiltable bolt lock 22 is also mounted in the bolt and has a shoulder 24 formed to engage a notch 26 disposed on the upper interior wall of the barrel extension. A stepped action-slide block 28, fixed to the reciprocally mounted action bars 13, 13 controls tilting movement of the bolt-lock 22 to engage the shoulder 24 in the notch 26 when the bolt 20 is locked and to disengage shoulder 24 from notch 26 when the bolt is unlocked.

The breech-bolt mechanism 18 is urged toward battery position by an action-return spring 32, housed in the stook (not shown). Spring 32 acts through an elongate link or strut 34 that engages the tail portions of the action bars 13.

Shotgun 10 further includes a tubular magazine 36, one end 38 of which opens into receiver 12 and is permanently attached thereto. The other end of magazine 36 is closed by a magazine cap (not shown) in the usual manner. Fresh shells are inserted end-to-end into the receiver end 38 of the magazine for storage and subsequent automatic delivery to the receiver by a coil spring (not shown) compressed within the magazine.

The general operation of the gun as described so far is more or less conventional. While the bolt is held retracted, a shell is inserted into the cartridge chamber 16 and the bolt released to close and lock the action. After each shell discharges, the bolt is moved out of battery position to eject the spent shell. Simultaneously, a fresh shell is delivered from the magazine to the receiver by the magazine follower spring. When the bolt returns to battery position, it loads the fresh shell into the chamber.

The gas system of the present invention, generally indicated at 42 in FIG. 1, initiates actuation of the breech-bolt mechanism through the reloading cycle described above. This system includes twin gas-receiving cylinders 44 and 46, each of which is tightly nestled against the assembled barrel and magazine in one of two generally V-shaped regions, $R_1$ and $R_2$ (FIGS. 3 and 4) defined by magazine 36 and barrel 14. Each of regions $R_1$ and $R_2$ opens outwardly from the plane defined by parallel barrel axis A and magazine axis B. Cylinders 44 and 46 are disposed in spaced parallel relation to each other and are fixed to a mounting bracket 48 that is fastened rigidly to the barrel, for example, by brazing. Mounting bracket 48 includes two cylindrical portions 50 and 52 (also respectively received in opposing generally V-shaped regions $R_1$ and $R_2$) which define open bores 54 and 56 adapted to receive reduced diameter, cylindrical extensions 58 and 60 of gas-receiving cylinders 44 and 46, respectively. As will be noted from FIG. 5, the outside diameter of cylindrical portions 50 and 52 is equal to that of cylinders 44 and 46 so that the cylinders and bracket 48 form continuous cylindrical surfaces. Consequently, the bracket 48 does not protrude laterally of the cylinders. Machine screws 62, 62 extend rearward through the cylindrical portions 50, 52 of mounting bracket 48 into threaded engagement with the tapped ends of cylinder extensions 58, 60 for retaining the cylinders in bracket 48.

Figure 7:
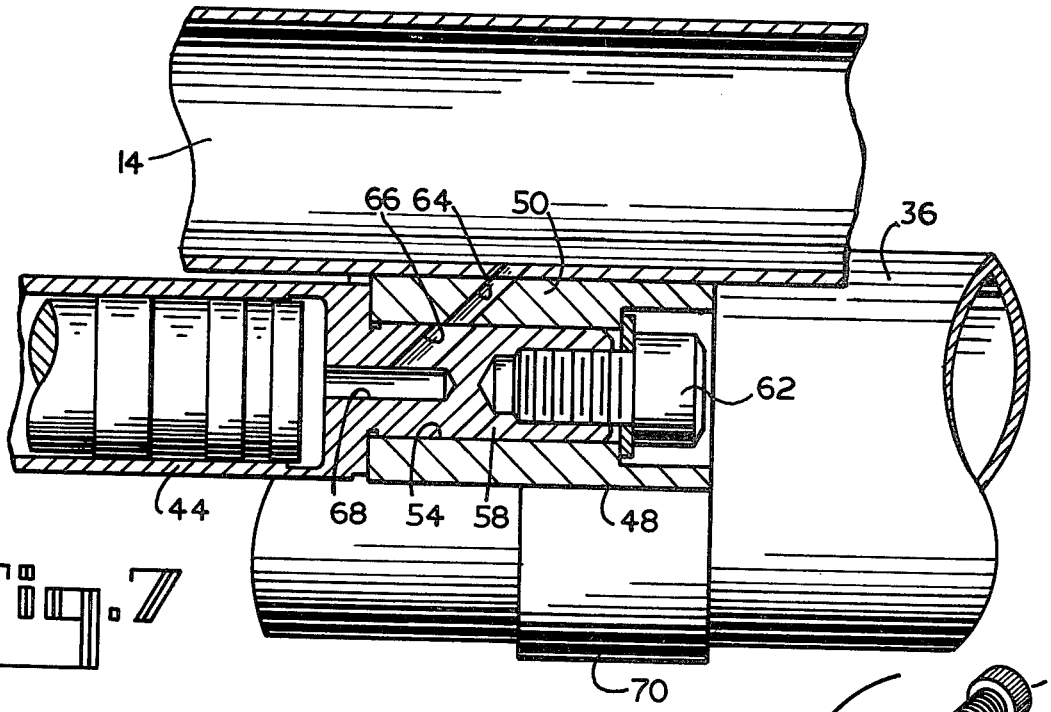
FIG. 7 is a cross-sectional view of the barrel and one piston-cylinder assembly, taken on the line 7—7 in FIG. 4.

As illustrated in FIG. 7 with respect to cylinder 44, the gases of combustion pass from the barrel 14 to cylinder 44 through a rearwardly inclined port 64 in the cylindrical portion 50 of bracket 48 and the wall of the barrel to a mating port 66 in the extension 58 of cylinder 44 and then into a blind hole 68 drilled axially from the inner end of cylinder 44. Corresponding passages are provided for simultaneously bleeding gas from the barrel to the other cylinder 46.

Figure 9:
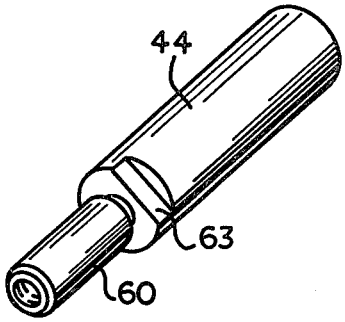
FIG. 9 is a perspective view of one of the cylinders shown in FIG. 8, but viewed from the opposite end to show an undercut portion used to achieve proper cylinder-bracket alignment.
Figure 8:
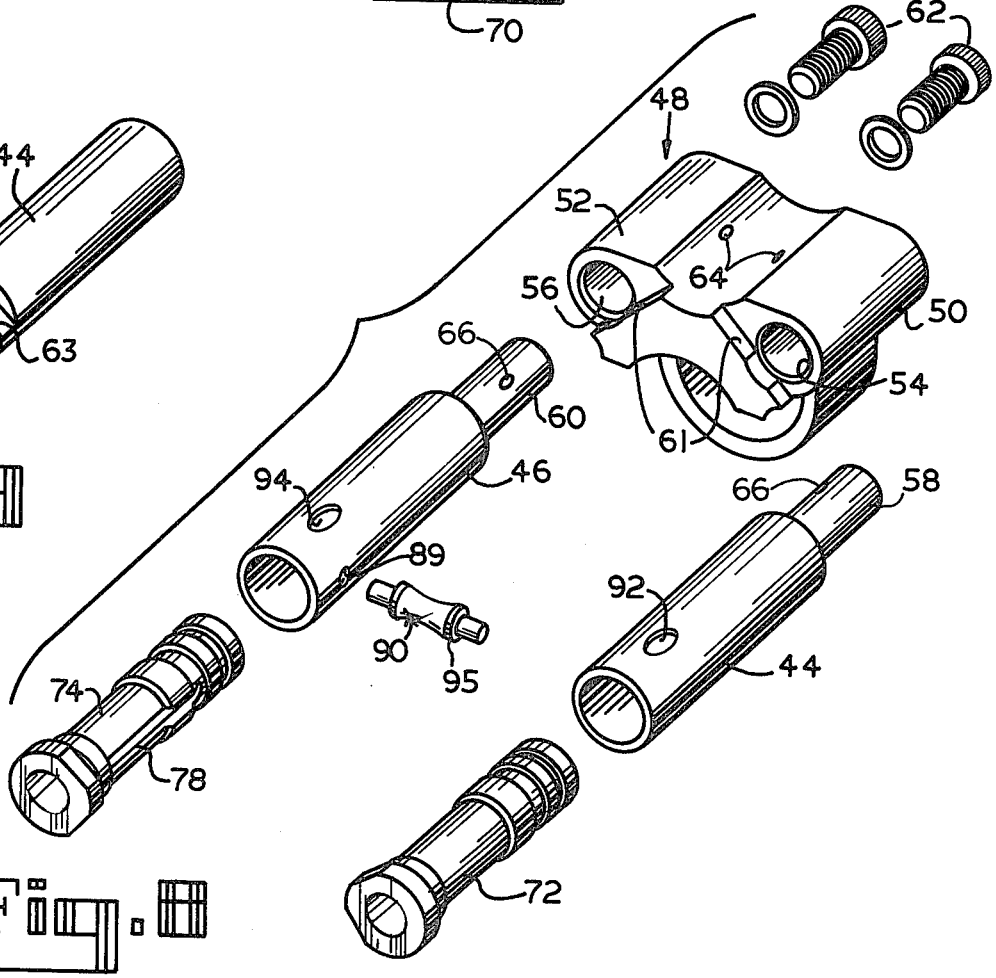
FIG. 8 is an exploded perspective view of both piston-cylinder assemblies and the mounting bracket.

In order to ensure alignment of port 66 in each cylinder with the port 64 in the mounting bracket, bracket 48 is provided on the face adjacent the open ends of its bores 54, 56 with positioning shoulders 61, 61 (FIG. 8), each of which mates with a corresponding shoulder 63 on the adjacent end of each of cylinders 44 and 46, as illustrated in FIG. 9. Likewise, in order to eliminate the need for close manufacturing tolerances to assure full alignment of the port in the gas cylinders with the ports in mounting bracket 48, the diameter of ports 66 is somewhat larger than the diameter of ports 64 and the central bores 68 are slightly larger in diameter than the ports 66, thereby facilitating full intersection of each port 64 with the corresponding port 66 and of each port 66 with the corresponding bore 68. In this way the size of ports 64 determines the orifice for the gas bleed-off from barrel 14.

Alignment of the portion of port 64 that is located in the barrel 14 with the portion in the bracket 48 is ensured by brazing the bracket to the barrel before the port 64 is drilled. However, it is desirable to partially drill the ports 64 from inside the bores 54, 56 of bracket 48 before it is brazed to the barrel. In this way, after the cylinder-mounting bracket is brazed to the barrel, the pre-drilled holes act as guides for completing the holes through both the bracket and the wall of the barrel. As may be seen in FIG. 7 access for drilling port 64 is obtained by inserting the drill at an angle through the open end of each of bores 54, 56 of bracket 48 before the cylinder 44, 46 are assembled thereto.

Mounting bracket 48 is also formed with a depending sleeve or ring 70, which receives and supports the tubular magazine 36 at a point spaced from the receiver in order to hold it rigidly parallel to barrel 14.

Figure 6:
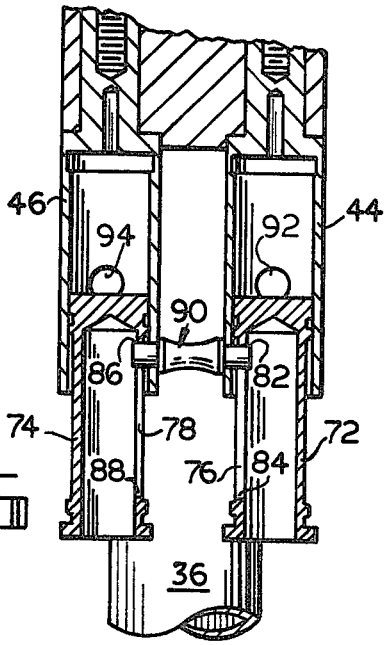
FIG. 6 is a view similar to FIG. 5, but showing only the piston-cylinder assemblies with the pistons fully extended.

A pair of hollow, cylindrical pistons 72 and 74 are provided in cylinders 44 and 46, respectively, for reciprocal movement to an extended position (FIG. 6). Each piston has an elongate slot 76 and 78 in one side, extending longitudinally of the piston and terminating in end walls 82 and 84 on piston 72 and end walls 86 and 88 on piston 74. A retaining stud 90, mounted between the cylinders, passes through holes 89 in their cylinder walls into the respective piston slots 76 and 78 to prevent disengagement of the pistons from the cylinders by engagement of the end walls or stop surfaces 82 and 86 of the slots in the pistons with the retaining stud 90.

Gas relief ports 92 and 94 are provided in both the upper and lower sides of cylinders 44 and 46, respectively, and are exposed to the interior of the cylinders when the pistons move to their extended positions, in order to vent gas from the cylinders. Accordingly, as the pistons approach their extended positions, the gas pressure behind them is relieved so that they are not driven with too much force against the retaining stud 90. Stud 90 is loosely supported at its ends in the cylindrical walls of cylinders 44 and 46, its central portion 95 being enlarged to form outwardly facing shoulders, which rest against the outer surfaces of the gas cylinders and prevent it from moving lengthwise. Since Stud 90 is free to rotate, it will constantly present different surfaces against which pistons 72 and 74 are stopped.

Figure 3:
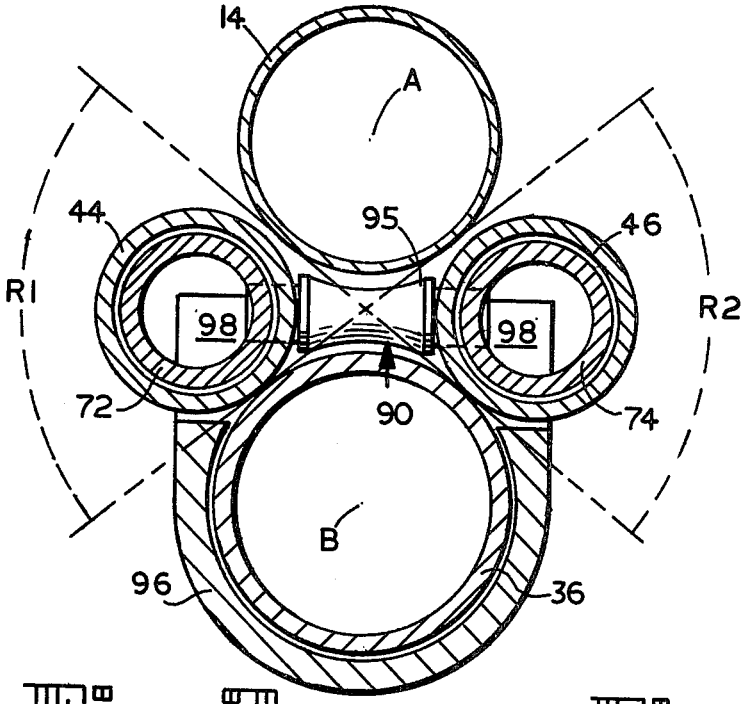
FIG. 3 is an enlarged vertical cross-sectional view of the twin piston-cylinder assemblies, taken on the line 3—3 in FIG. 1 looking in the direction of the arrows.
Figure 5:
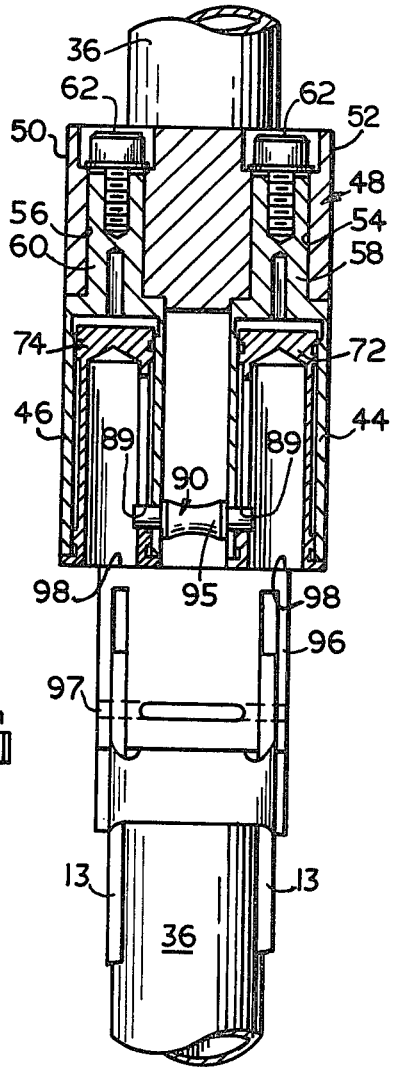
FIG. 5 is a horizontal cross-section view of the gas-power system taken on the line 5—5 in FIG. 1, on a scale larger than that of FIG. 1 but smaller than that of FIGS. 3 and 4.
Figure 4:
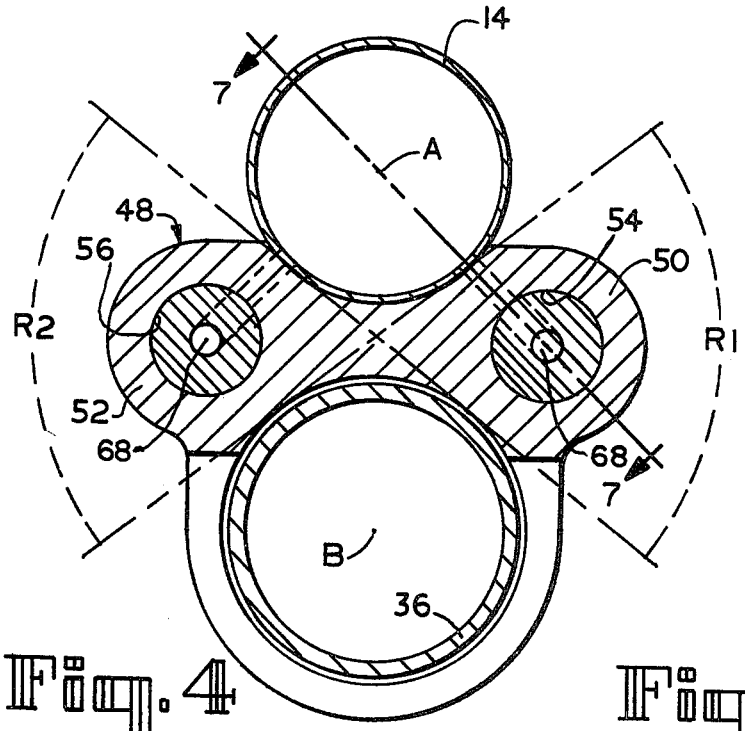
FIG. 4 is an enlarged vertical cross-sectional view through the mounting bracket which carries the twin piston-cylinder assemblies, taken on the line 4—4 in FIG. 1 looking in the direction of the arrows.

As shown in FIGS. 1—3, an inertial weight 96 is loosely mounted on the tubular magazine 36 and is coupled to action bars 13, 13 at their forward ends by means of a transverse pin 97 (FIG. 5). Therefore, reciprocal movement of weight 96 causes similar movement of breech-bolt mechanism 18 to and from battery position. When bolt mechanism 18 is in its battery position, weight 96 is positioned in the manner shown in FIGS. 1 and 5 in operative relation with the gas pistons 72, 74; that is, the heads of both pistons abut impact surfaces 98, 98 formed on weight 96.

It will be noted from FIG. 5 that each of the pistons 72, 74 is directly in line with one of the action bars 13, 13 so that the force exerted by it against inertial weight 96 is transmitted along the line of each action bar to the bolt mechanism. Consequently, the twin-piston gas system of the present invention effectively maintains alignment of the inertial weight and action bars, ensuring smoother operation of the reloading mechanism and reducing friction and wear between the inertial weight and magazine tube, as well as between the action bars and the guide surfaces in the receiver against which they slide.

In order to keep the size of the forend within acceptable limits, it is important to proportion the size of the gas-power cylinders to the size of the barrel and magazine and to space the barrel and magazine a suitable distance from each other so that the cylinders nestle properly in the troughs formed on both sides of the barrel and do not extend outwardly beyond the confines of the forend housing.

Inertial weight 96 is an elongate, generally cylindrical member, the upper forward portion of which is cut away at 99 to form the impact surfaces 98, 98, which are located about midway between its front and rear ends. In this way inertial weight 96 can be made as long as necessary to provide the weight required to function the action so that it does not have to be made so wide that the forend of the gun is bulky. However, by extending the weight 96 forwardly under the twin-cylinders 44, 46, instead of outwardly or rearwardly, it neither takes up the space required to operate the bolt, nor increases the cross-sectional dimension of the forend. This provides a distinct advantage over gas systems that employ an annular piston of the type first disclosed in the aforementioned patent to Hillberg U.S. Pat. No. 2,909,101.

The apparatus of the present invention operates as follows. When a round is fired, gas pressure is developed behind the load as it travels through the barrel. A portion of the gases of combustion is bled through the gas ports connecting the interior of the barrel to the interior of the two cylinders. The gas pressure thus developed in the cylinders drives the pistons to their extended positions and simultaneously forces the inertial weight rearward toward the receiver. While the rearward stroke of each piston is limited, the initial impact and force developed by the compressed gas inparts sufficient energy to inertial weight 96 to drive it to its rearmost position shown in FIG. 2. During this rearward stroke, the spent shell is ejected from the receiver and a new shell is raised into position in front of the bolt so that when the bolt is driven forward again the new shell is fed into the chamber.

What is claimed is:

1. In a gas-operated autoloading shotgun having a receiver, a bolt mechanism mounted for reciprocal movement to and from a battery position in the receiver, return-spring means for urging the bolt mechanism to battery position, a barrel secured to said receiver, and a tubular magazine mounted under, parallel to, and spaced from, said barrel, the outer surfaces of said barrel and magazine defining two opposing generally V-shaped regions that open outwardly from a plane defined by the longitudinal axes of said barrel and magazine, an improved gas-power system therefor comprising a pair of gas cylinders each mounted on said barrel in opposite ones of said V-shaped regions, said cylinders being symmetrically disposed relative to said axial plane and substantially tangent to both said barrel and said tubular magazine, gas-port means interconnecting the interior of said barrel with the interior of each of said cylinders, a piston mounted for reciprocal movement within each of said cylinders, an inertia weight carried by said magazine for reciprocal movement thereon into operative relation with said pistons, a pair of parallel action-bars disposed intermediate said barrel and magazine member for transmitting the force exerted by said pistons to said bolt mechanism for moving said bolt mechanism out of battery position against the pressure of said return-spring means when a cartridge is fired, each of said action-bars being disposed substantially in line with one of said pistons, means for connecting said action bars to said inertial weight, and means for limiting the reciprocal movement of each of said pistons within its cylinder comprising an elongate longitudinally extending slot in each of said pistons having a stop surface at one end, and an abutment member mounted in connection with each of said cylinders at a fixed position axially thereof and projecting into said elongate slot for engagement by said stop surface for preventing disengagement of said piston from said cylinder.

2. A gas-power system as defined in claim 1, wherein said abutment member comprises an elongate stud disposed in the space between said barrel and magazine such that it intersects the plane defined by the longitudinal axes thereof, said stud spanning the distance between said cylinders and projecting at opposite ends through the walls thereof into the respective slots of said pistons.

3. A gas-power system as defined in claim 1, which further includes means for relieving gas pressure developed in said cylinder prior to movement of said stop surfaces on said pistons into engagement with their respective abutment members.

4. A gas-power system as defined in claim 3, wherein said gas relief means comprises an opening to the atmosphere through the wall of each of said cylinders, said opening being disposed axially of said cylinder such that it is uncovered by the piston prior to engagement of the stop surfaces on said piston with its abutment member.

5. A gas-power system for a gas-operated autoloading shotgun having a receiver, a barrel removably mounted on said receiver and a tubular magazine mounted on said receiver under, parallel to, and spaced from, said barrel, said gas-power system comprising a pair of gas cylinders symmetrically disposed relative to said barrel, each of said cylinders having a cylindrical extension of reduced diameter co-axial therewith, a bracket rigidly mounted on said barrel and having a pair of open bores disposed parallel to said barrel, for receiving and supporting said extensions on said cylinders, means for detachably securing said cylinder extensions in said bores, gas-port means in said extension, bracket and barrel interconnecting the interior of said barrel with the interior of each of said cylinders, a piston mounted for reciprocal movement within each of said cylinders, and means for limiting such reciprocal movement of each of said pistons within its cylinder.

6. A gas-power system as defined in claim 5, wherein said limiting means comprises an elongate longitudinally extending slot in each of said pistons having a stop surface at one end and an abutment member mounted in connection with each of said cylinders at a fixed position axially thereof and projecting into said elongate slot for engagement by said stop surface for preventing disengagement of said piston from said cylinder.

7. A gas-power system as defined in claim 6, wherein said abutment member comprises an elongate stud disposed in the space between said barrel and magazine such that it intersects the plane defined by the longitudinal axes thereof, said stud spanning the distance between said cylinders and projecting at opposite ends through the walls thereof into the respective slots of said pistons.

8. In a gas-operated autoloading firearm having a receiver, a bolt mechanism mounted for reciprocal movement to and from a battery position in the receiver, return-spring means for urging the bolt mechanism to battery position, and a barrel secured to said receiver, an improved gas-power system therefor comprising a pair of gas cylinders each mounted on said barrel, said cylinders being symmetrically disposed relative to said barrel, a bracket fixed to said barrel and having means for detachably mounting said cylinders, a piston mounted for reciprocal movement within each of said cylinders, each of said cylinders being provided with a cylindrical extension co-axial therewith, said bracket being formed with a pair of open bores to receive the cylindrical extensions of said cylinders, gas-port means interconnecting said barrel with each of said cylinders and comprising a first passage in each of said extensions from the interior of the corresponding cylinder to the cylindrical surface of its said extension, said gas-port means further comprising a second passage in said bracket from each of said bores to the interior of said barrel member, positioning means on said bracket and cylinders for aligning said first passages with said second passages on assembly of said cylinders with said bracket, and a pair of parallel action-bars disposed longitudinally of said barrel for transmitting the force exerted by said pistons to said bolt mechanism for moving said bolt mechanism out of battery position against the pressure of said return-spring means when a cartridge is fired, each of said action-bars being disposed substantially in line with one of said pistons.

9. A gas-power system as defined in claim 8, wherein said positioning means comprises a shoulder on said bracket adjacent the opening to each of said bores and a mating shoulder on each of said cylinders adjacent said extension.

* * * * *